United States Patent [19]

Siczek

[11] 3,944,141

[45] Mar. 16, 1976

[54] SPRAY GUN SHIELD AND TRIGGER SAFETY APPARATUS

[75] Inventor: Bernard Siczek, La Grange Park, Ill.

[73] Assignee: Graco Inc., Minneapolis, Minn.

[22] Filed: May 19, 1975

[21] Appl. No.: 578,543

[52] U.S. Cl. ..... 239/288.5; 239/526

[51] Int. Cl.[2] ..... B05B 15/04; B05B 11/00

[58] Field of Search ..... 239/288–288.5, 239/499, 505, 507, 508, 521, 522, 525–528

[56] References Cited

UNITED STATES PATENTS

| | | | |
|---|---|---|---|
| 2,566,878 | 9/1951 | Fahrenkrog et al. | 239/288 |
| B450,927 | 1/1975 | Petrovic | 239/600 X |

FOREIGN PATENTS OR APPLICATIONS

| | | | |
|---|---|---|---|
| 582,079 | 11/1946 | United Kingdom | 239/288.5 |

*Primary Examiner*—John J. Love
*Assistant Examiner*—Andres Kashnikow
*Attorney, Agent, or Firm*—Paul L. Sjoquist

[57] ABSTRACT

Apparatus is disclosed for forming a paint spray gun having a protective hood about the spray orifice, wherein the hood may be pivotally lifted for cleaning and other purposes. A cam surface connected to the hood disables the spray gun trigger apparatus, which in turn prevents the spray gun paint valve from being actuated.

9 Claims, 5 Drawing Figures

FIG. 4
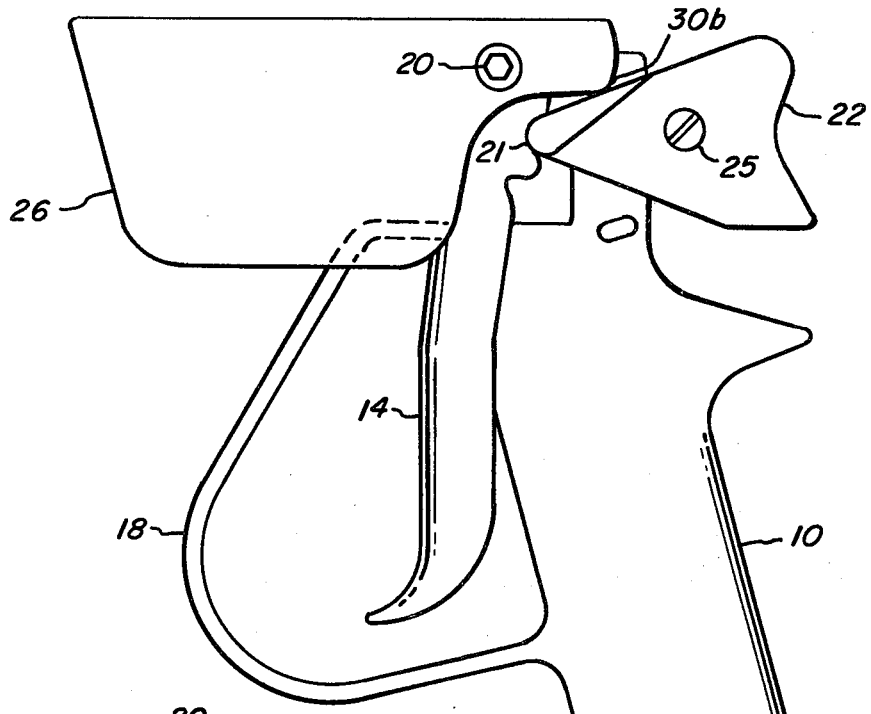
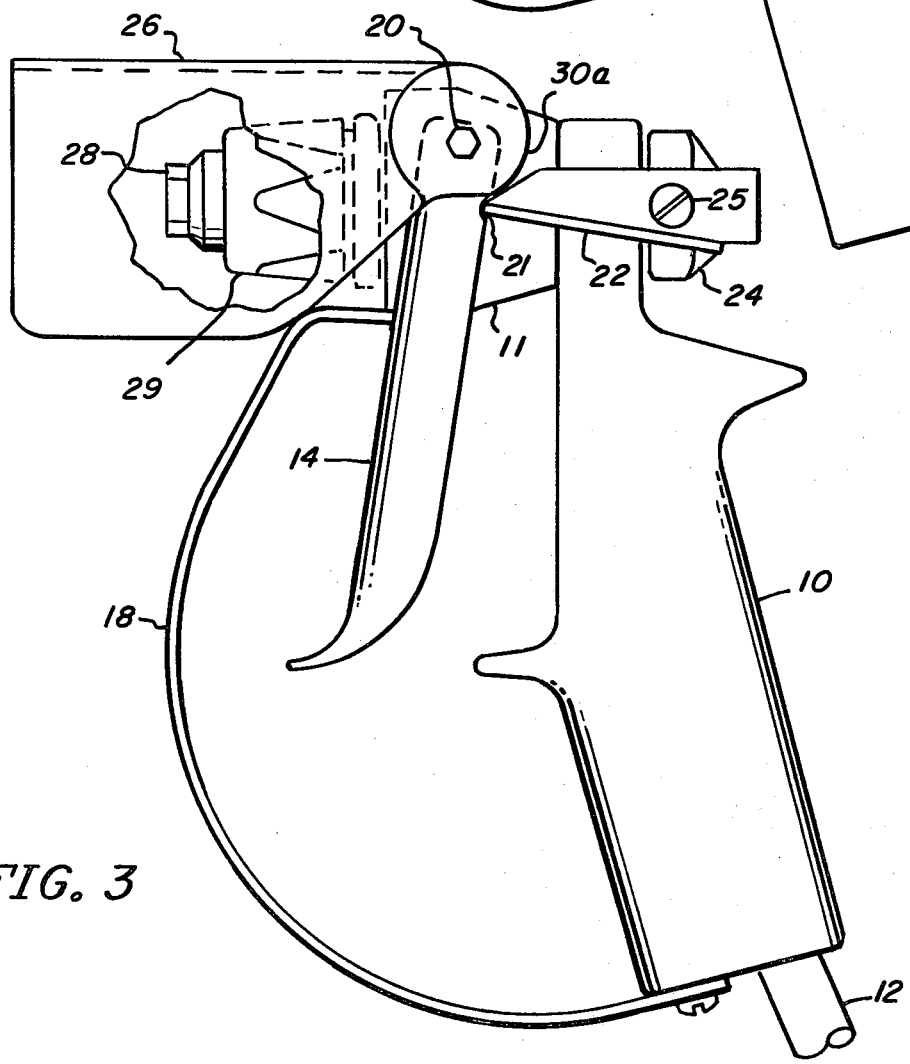
FIG. 3

SPRAY GUN SHIELD AND TRIGGER SAFETY APPARATUS

BACKGROUND OF THE INVENTION

This invention relates to a spray gun apparatus for spraying paint and the like. The invention particularly relates to a safety apparatus for guarding the region near the paint spray orifice and for disabling the spray gun trigger, and to a spray actuating mechanism which operates in cooperation with the safety apparatus.

In the field of painting, and particularly paint spraying, there has been developed apparatus and techniques for spraying paints under high hydraulic pressures. The apparatus usually embodies a pistol-shaped spray gun having a trigger which controllably actuates a valve for admitting paint into a chamber and emitting it from the chamber through an orifice. Because of the extremely high hydraulic pressures utilized in this type of spray gun the emitted paint travels at high particle velocities which are sufficient to penetrate the skin if one comes within several inches of the paint spray orifice. Beyond this "critical zone" of danger the paint particle velocities are reduced to a point where they are not sufficient for skin penetration and are therefore not dangerous. It is therefore important to guard against close personal contact with the region near the paint spray orifice, and operators are typically warned of this danger through various means. Apparatus has been developed to provide a guard around the region of the paint spray orifice in order to prevent a person from coming into contact with this region. For example, in U.S. patent application Ser. No. 532,021, filed Dec. 12, 1974, and owned by the same assignee as the current invention, a novel guard is described which accomplishes the purpose of protecting against personal contact with the region around the paint spray orifice.

Another approach to preventing inadvertent spraying is to design a safety guard mechanism for disabling the paint spray gun trigger whenever the gun is not actually being used for spraying. U.S. patent application Ser. No. 450,927, filed Mar. 13, 1974, now U.S. Pat. No. 3,913,844, and owned by the same assignee as the present invention describes a trigger disabling feature which is but one of a number of approaches to solving this problem.

Improved safety features of the general class described above have been incorporated into the basic spray gun operating mechanism which includes a trigger actuator and a paint spray valve mechanism. As hereinbefore stated, the valve operates to open a passage between the pressurized paint chamber within the spray gun and the paint spray orifice. In such a spray apparatus, the pressurized paint line is typically attached to the spray gun, usually to its handle, and internal passages provide a conduit for the pressurized paint to travel to the paint chamber openable by the valve.

SUMMARY OF THE INVENTION

The present invention comprises a paint spray gun having a paint supply connection directly to the gun body at a point near the paint spray chamber. The apparatus further has a novel valve and actuating mechanism for passing paint into the spray tip and sealably confining the internal pressurized paint from leaking external the spray gun. Further, the present invention includes a novel and pivotal guard which surrounds the exterior region near the paint spray orifice to protect against inadvertent operator contact. The guard is pivoted about the same point as the spray gun trigger, and a cam arrangement which forms a part of the guard disables the trigger actuating mechanism whenever the guard is pivoted away from protective contact with the paint spray orifice. When the trigger mechanism is disabled the paint spray valve cannot be opened, thus preventing inadvertent spraying from the paint spray orifice.

BRIEF DESCRIPTION OF THE DRAWINGS

FIG. 3 illustrates an alternative embodiment of the invention; and

FIG. 4 illustrates another alternative embodiment.

DETAILED DESCRIPTION OF THE INVENTION

Figure 1:
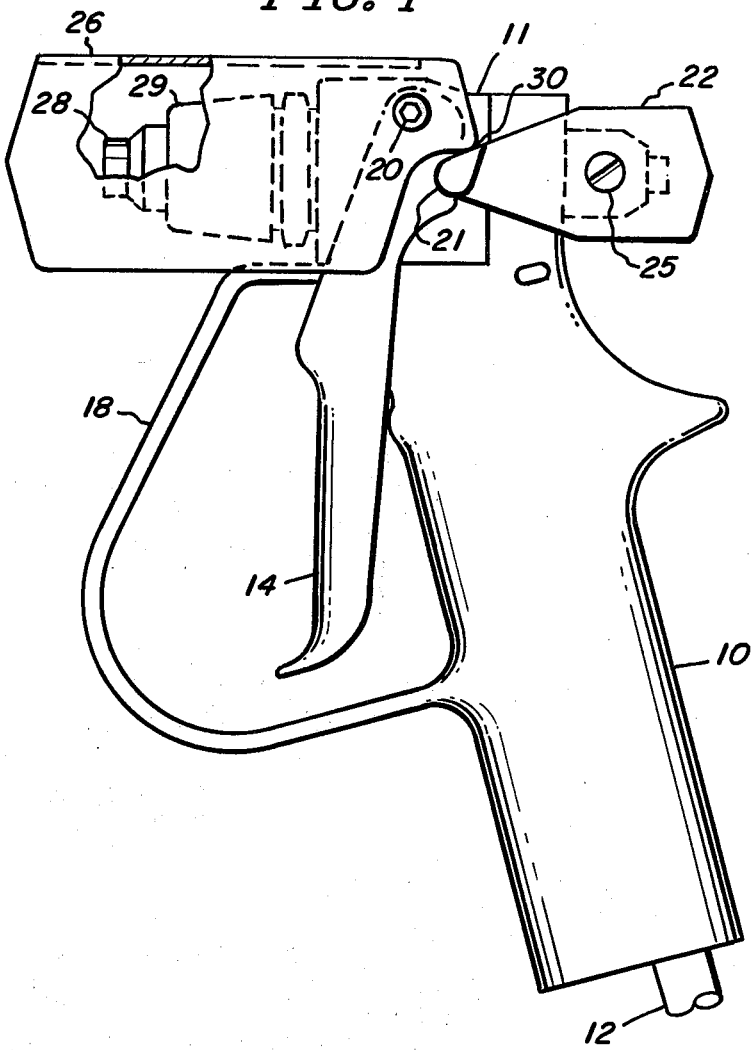
FIG. 1 illustrates a preferred embodiment in side view.

Referring first to FIG. 1, the invention as shown in side view. A handle 10 forms a portion of the main body of the spray gun, the remaining portion being a barrel 11. A flexible hose 12 designed for connecting to a supply of highly pressurized paint is attached to the underside of the spray gun. By way of example, the hydraulic paint pressures intended for use in conjunction with the invention may range from pressures of 500 pounds per square inch (p.s.i.) to 2,000 p.s.i., and it is necessary that hose 12 and barrel 11 be capable of withstanding pressures exceeding the upper limit of this range. A trigger 14 is used to actuate the spray gun, by opening an internal paint spray valve. Trigger 14 has a trigger guard 18 in shielding configuration around it in order to prevent inadvertent triggering of the spray gun.

Trigger 14 pivots about pin 20, and its rearward movement is transmitted to trigger lever 22 through its contact point at notch 21. A second trigger lever and notch are also found on the other side of the spray gun, so that rearward movement is distributed evenly across the spray gun assembly. Trigger lever 22 is attached by a bolt 25 or other suitable fastening means to a valve nut 24. Valve nut 24 is connected to the spray gun valve actuating mechanism so that its rearward movement causes the paint valve to open and allows the spray gun to emit paint spray under high pressure through spray tip 28. Spray tip 28 is clamped against gun body 11 by means of a threaded tip nut 29. This portion of the invention is common and well known in the prior art.

A tip guard 26 forms a protective shield about tip 28 and the region forward of tip 28. Tip guard 26 is also pivotally mounted on pivot pin 20, and the tip guard may be pivoted upwardly to swing clear of the tip 28 end of the spray gun. This pivotal function is necessary in order to enable the operator to loosen tip nut 29 for purposes of cleaning or replacing spray tip 28. The pivot mounting of tip guard 26 allows the creation of a cam surface 30 for disabling trigger lever 22 whenever tip guard 26 is lifted out of protective position. It is apparent from FIG. 1 that the cam surface 30 bears against the edge of lever 22 and forces lever 22 downwardly whenever tip guard 26 is raised or pivoted upwardly. This causes lever 22 to disengage from notch 21 and effectively disengages its mechanical contact with trigger 14. With tip guard 26 in an upward position the squeezing of trigger 14 will not engage lever 22, and therefore the paint spray valve is prevented from opening to release paint.

Figure 2A:
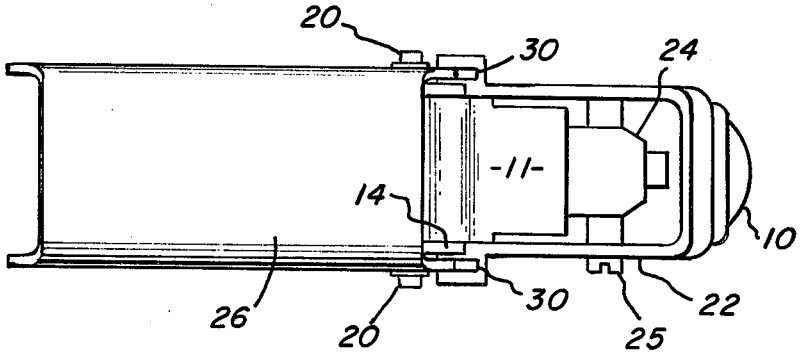
FIG. 2A illustrates a top view of the invention.

FIG. 2A illustrates the spray gun in top view. It is seen that pin 20 extends all the way through the spray gun body 11, and may take the form of a suitable bolt and nut fastener. Trigger lever 22 forms a U-shaped bracket pivotally mounted on bolts 25 and extending on either side of barrel 11 to contact respective cam surfaces 30, and also to bear against trigger 14 on both sides of barrel 11. FIG. 2A also illustrates the hooded protective construction of tip guard 26. It is apparent that an operator is prevented from placing his hand anywhere near the region of spray tip 28 which is considered dangerous because of the emission of high-velocity paint particles.

Figure 2B:
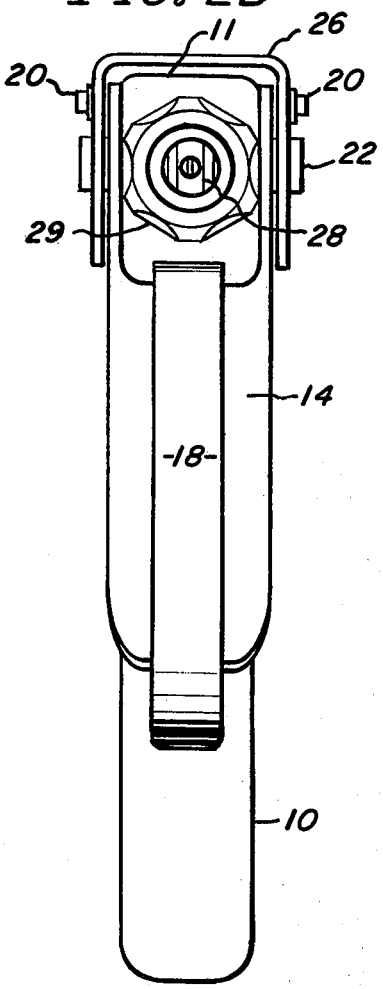
FIG. 2B illustrates a front view of the invention.

FIG. 2B is a front view of the invention, which further illustrates the hooded shape of tip guard 26. It can be seen that the spray tip 28 is centered within the protected region defined by the surface of tip guard 26. Since, in the design and use of a typical paint spray gun, the spray pattern emitted from spray tip 28 is vertically fan-shaped and horizontally quite narrow, spray tip 28 must be positioned relative to the front edge of guard 26 so that none of the spray contacts guard 26.

FIG. 3 illustrates an alternative embodiment of the invention, wherein the shape of cam surface 30a is modified slightly to give a different operating characteristic. Whereas the cam surface 30 shown in FIG. 1 causes the lever 22 to quickly disengage from notch 21 when tip guard 26 is raised, the same elements in the illustration of FIG. 3 will cause a smoother trigger 14 disengagement from lever 22. Aside from the more rounded shape of cam surface **30*a* in FIG. 3, which tends to give a smoother disengagement characteristic, cam surface 30a bears against lever 22 at a point farther removed from pivot point 25, thus requiring relatively more cam deflection to unseat lever 22 from notch 21**.

Conversely, FIG. 4 illustrates an embodiment of the invention which quickly and decisively unlatches lever 22 from notch 21. This is accomplished by the shaping and positioning of cam surface **30*b* closer to pivot point 25 of lever 22. A very slight upward pivoting movement of tip guard 26 will cause cam surface 30*b* to unlatch lever 22 from notch 21. However, a greater upward force on tip guard 26 is required to unlatch lever 22 in the FIG. 3** example.

Depending on the operating characteristics desired any of the three alternative embodiments described herein may be used satisfactorily, provided that trigger 14 becomes disengaged from lever 22 before tip guard 26 is pivoted upwardly sufficiently high to expose the paint spray pattern which emits from spray tip 28. To further modify the operating charcteristics of any of the embodiments described herein, it may be desired to bias lever 22 in an unlatched position through the use of a suitable spring. For example, such a spring may be positioned between lever 22 and its pivot point about bolts 25 such that it imparts a downward force on the end of lever 22 seated in notch 21. This spring action can assist in unlatching lever 22 from contact with notch 21. Moreover, once lever 22 is unlatched, the spring tends to hold lever 22 downwardly and out of engagement with notch 21 regardless of the position of the spray gun. This tends to prevent any inadvertent latching of lever 22 which might occur if the gun's position were changed.

In operation, trigger lever 22 provides the mechanical force transfer member between trigger 14 and valve nut 24 for so long as tip guard 26 remains in the lowered position. However, when tip guard 26 is raised, by pivoting it about pivot pin 20, cam surfaces 30 force trigger lever 22 downwardly and out of contacting relationship with notches 21 of trigger 14. This removes the trigger force transfer member from contact with the trigger and prevents valve nut 24 from being actuated by the trigger. When tip guard 26 is returned to its lowered position trigger lever 22 can again be latched into contact with notches 21 to make the spray gun trigger operative.

What is claimed is:

1. A safety spray gun apparatus for accepting hydraulically pressurized fluid and for emitting an atomized fluid spray through an orifice under control of an actuating trigger, which opens an internal valve to permit fluid flow, comprising:

a. a valve rod connected to said internal valve and sealably projecting external said spray gun;

b. an actuating arm pivotally attached to the projecting end of said valve rod and contacting said actuating trigger; and c. a spray orifice shield pivotally mounted on spray gun, the region about said mounting point being constructed in an eccentric cam surface contacting said actuating arm, said shield having a forwardly projecting hood for at least partially blocking the region forward of the spray orifice, whereby the shield may be lifted about its mounting point and said cam surface will engage said actuating arm to move it from contact with said actuating trigger.

2. The apparatus of claim 1 wherein said trigger further comprises a notch for contacting said actuating arm end.

3. The apparatus of claim 2 wherein said trigger is pivotally mounted about the same mounting point as said spray orifice shield.

4. The apparatus of claim 3 wherein said trigger pivot mounting further comprises an extended arm on either side of said spray gun, each arm having a pivotal mounting connection to said spray orifice shield mounting point.

5. The apparatus of claim 4 wherein said spray orifice shield further comprises a pivotal mounting connection on each side of said spray gun, and said actuating arm further comprises a section on each side of said spray gun in contact with respective extended arms of said trigger.

6. The apparatus of claim 5 wherein each of said spray orifice shield pivotal mounting connections includes an eccentric cam surface about the respective mounting points.

7. The apparatus of claim 6 wherein said spray orifice shield hood projects at least one inch forward of said spray orifice.

8. Safety apparatus and guard for use on a high pressure spray device to shield the high pressure spray from contacting the operator and for disabling the spray device valve, comprising:

a. a pivot pin attached to the spray device and having pivotally attached thereto the trigger of the spray device;

b. an arm attached to the spray device valve and having a first position in valve operable contact with said trigger and having a second position out of valve operable contact with said trigger;

c. a spray orifice shield at least partially shielding the region near the exterior of the spray orifice, said shield being pivotally mounted to said pivot pin and having a cam surface about its mounting pivot in contact with said arm, whereby the cam permits operable engagement of the arm with the trigger when the shield is in shielding position about the orifice and the cam prevents operable engagement of the arm with the trigger when the shield is pivoted away from shielding position about the orifice.

9. The apparatus of claim 8 wherein said spray orifice shield extends at least one inch forward of said spray orifice.

* * * * *